United States Patent [19]

Wertheimer et al.

[11] 4,410,170

[45] Oct. 18, 1983

[54] MACHINE FOR STAPLING AND FOLDING A STACK OF PAPER SHEETS TO FORM A BOOK

[75] Inventors: Bruce Wertheimer, 2323 Davis St., P.O. Box 836, North Chicago, Ill. 60064; Rune S. Pearson, Torrence, Calif.

[73] Assignee: Bruce Wertheimer, Sarasota, Fla.

[21] Appl. No.: 168,301

[22] Filed: Jul. 10, 1980

[51] Int. Cl.[3] ..... B41L 43/12

[52] U.S. Cl. ..... 270/37; 493/444

[58] Field of Search ..... 270/37, 53; 156/92–93, 156/443, 513, 563; 227/3, 5–7, 19, 99–106; 493/444–445, 118–119, 383–385, 394; 29/432–432.2; 53/157

[56] References Cited

U.S. PATENT DOCUMENTS

| | | | |
|---|---|---|---|
| 1,287,334 | 12/1918 | Kast | 270/53 |
| 2,007,210 | 7/1935 | Neidig | 493/445 |
| 2,335,970 | 12/1943 | Schmidt | 493/445 |
| 2,470,754 | 5/1949 | Alber | 493/444 X |
| 3,536,318 | 10/1970 | Gay | 270/53 X |
| 3,554,531 | 1/1971 | Heigl | 270/37 X |
| 3,901,501 | 8/1975 | Kistner | 493/444 |
| 3,926,425 | 12/1975 | Pierce | 493/444 |
| 4,270,742 | 7/1981 | Kobayashi | 270/37 |

*Primary Examiner*—A. J. Heinz
*Attorney, Agent, or Firm*—Keil & Witherspoon

[57] ABSTRACT

Machines for stapling and folding a stack of paper sheets, having a reciprocable tray to receive and move a stack of paper sheets between a rest, stapling position and a sheet-folding position; solenoid-operated staplers to staple together said sheets in a stapling line, a blade on said machine reciprocally movable between a rest position and a sheetfolding, extended position wherein an edge of said blade presses against said stack of paper sheets at said stapling line, a power-driven pair of spaced, opposed rollers with the nip between rollers aligned with said blade to allow said blade in its extended position and the bent stack of paper sheets thereon to enter said nip, whereupon said power-driven rollers grip and fold said sheets along said stapling line, electrically powered drive means to move said blade to extended position when said tray is moved into said sheet-folding position, whereby said power-driven pair of rollers lift the stapled, folded sheets off of said blade and convey said stapled, folded sheets for ejection as a stapled, folded book, a second pair of power-driven, spaced, opposed rollers having a nip aligned with the nip of said first-mentioned pair of rollers in the extended plane of said blade, the nip of said second pair of rollers being narrower than the nip of said first-mentioned pair of rollers to impart to said stapled, folded sheets a sharp bend of approximately 180° and also to eject the stapled book from said rollers toward a book collection tray, and a switch activated by movement of said tray to said sheet-folding position to cause the electrically powered drive means for said blade to reciprocate it into said sheet-folding, extended position.

9 Claims, 13 Drawing Figures

MACHINE FOR STAPLING AND FOLDING A STACK OF PAPER SHEETS TO FORM A BOOK

STATEMENT OF THE INVENTION

The invention herein pertains to machines which receive a stack of printed paper sheets to be bound and folded to form a book, staple said sheets together along a stapling line corresponding to the fold line for said sheets, and fold and crease the stapled sheets along the fold line to produce a book.

The machines have a tray to receive a stack of paper sheets. The tray moves between a rest position and a sheet-folding position. Stapler means mounted on the machines staple together said sheets in a stapling line while the sheets are stacked on the tray. A reciprocable blade on the machines reciprocally is moved between a rest position and a sheet-folding, extended position by drive means. An edge of said blade presses against the stack of paper sheets at the stapling line to cause said stack to bend along said stapling line. A power-driven pair of spaced, opposed rollers is on said machines with the nip between rollers aligned with the blade to allow the blade in its extended position and the bent stack of paper sheets thereon to enter said nip, whereupon the power-driven rollers grip and further fold said sheets along said stapling line. The blade moves from rest position to extended position when said tray is moved into said sheet-folding position, whereby said power-driven pair of rollers lift the stapled, folded sheets off of said blade and convey said stapled, folded sheets for ejection as a stapled, folded book.

Preferably, the machines have a second pair of power-driven, spaced, opposed rollers having a nip aligned with the nip of said first-mentioned pair of rollers in the extended plane of said blade. The nip of said second pair of rollers is narrower than the nip of said first-mentioned pair of rollers to impart to said stapled, folded sheets a sharp bend of approximately 180° (a crease) after which the stapled books are conveyed to a book collecting receptacle. The machines have switch means activated by movement of said tray to said sheet-folding position to cause electrically powered drive means for said blade to reciprocate it into said sheet-folding, extended position.

Further, the machines have staplers activated by electrically-energized solenoids in a circuit having switch means to control the operation of the solenoids. The blade and the nip(s) of rollers are aligned at an angle displaced from the vertical. The stapled, folded books are deflected and conveyed by additional rotary conveyor means and fall laterally onto a book-collecting receptacle on said machine.

Most preferably, the tray is mounted on said machines by means providing for its reciprocable movement between its rest (stapling) position and its sheet-folding position. In an electrical circuit for energizing said drive means for the blade, there is a normally-open switch in said circuit adjacent said tray. Switch actuator means on said tray is positioned to close said switch and energize said drive means to move and hold said blade in its extended position until the stapled, bent stack of paper sheets has been conveyed off of said blade by the rollers.

PRIOR ART

Machines and apparatus which separately staple or separately fold a stack of paper sheets are known in the art. No machines prior to those disclosed herein performed both the stapling and the folding function to enable production of staple-bound books rapidly and efficiently by a single machine-operator.

PREFERRED EMBODIMENT

Preferred embodiments of the invention are illustrated in the drawings, wherein.

Figure 1:
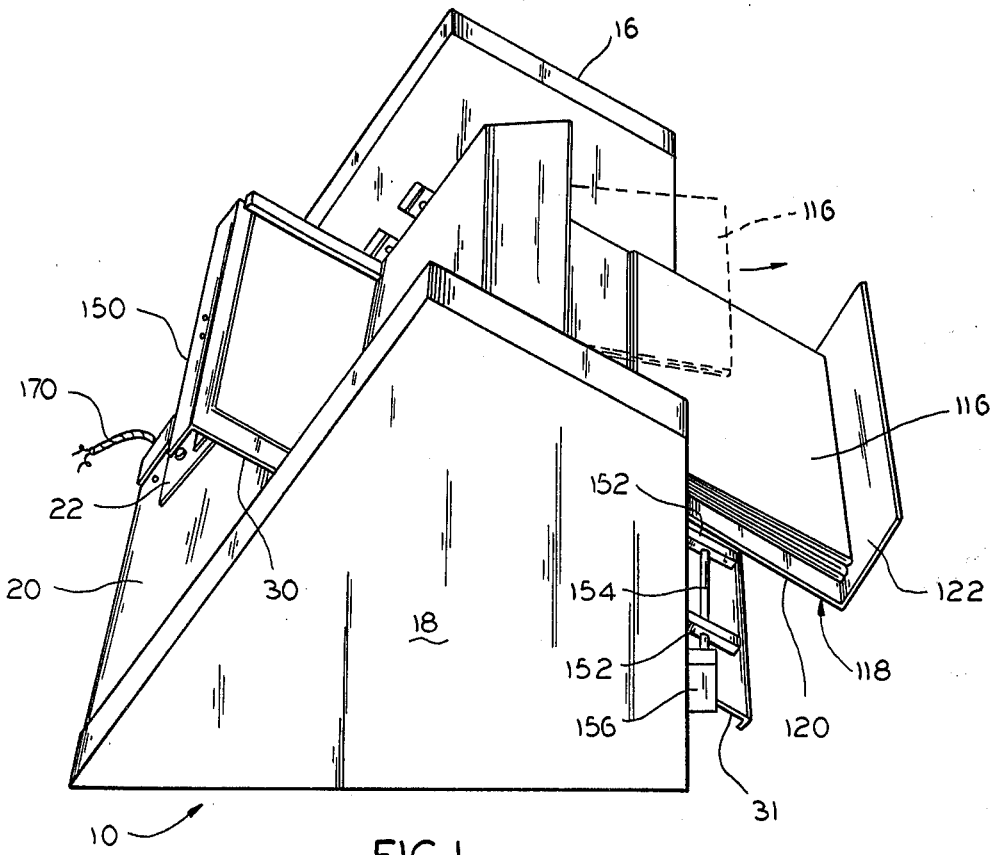
FIG. 1 is a side angle, perspective view of one preferred embodiment of the machine.

Referring to the drawings, the stapling and folding machine 10 comprises a frame having side plates 12 and 14. Each frame side plate is covered and hidden by side covers 16 and 18.

The front cover plate 20 has a panel 22 bearing a digital counter 24, electrically triggered by a state-of-the-art electrical circuit (not shown) to indicate the number of books produced for a given job order. An on-off master switch 26 in the electrical supply line to the machine puts the machine in the on or off functionality.

The basic components of the machine are a reciprocable tray 30 and a coplanar fixed tray 31 on which are laid a stack of paper sheets to be stapled and folded, the plane of the trays being pitched in the order of 20° to 40°; a set of staplers 32 positioned above the fixed tray with the staple bending anvils for respective staplers being mounted on the upper side of the fixed tray; a sheet-bending blade 34 reciprocably driven at substantially right angles to the plane of the tray between a retracted, rest position beneath the reciprocable tray and an extended position in which the leading edge of the blade projects above the trays, when the reciprocable tray is retracted, to create an upward bend in the paper sheets; a first pair of opposed, spaced rollers 36,38 above the reciprocable tray and rotatably driven about axes parallel with the extended plane of the blade 34 and on opposite sides of the extended plane to provide a nip aligned with said blade; a second pair of opposed, spaced rollers 40,42 above the first pair of rollers 36,38 and rotatably driven about axes parallel with the extended plane of the blade 34 with the nip of rollers 40,42 substantially aligned with the plane of the blade 34 and the nip between rollers 36,38; and, optionally, a removable, normally stationary receptacle onto which fall the stapled, folded books produced by the machine and discharged diagonally upwardly from the second pair of rollers.

THE RECIPROCABLE TRAY

The tray 30 comprises a planar sheet 40 disposed at an angle of about 30° relative to horizontal. It is reciprocally mounted in slide bearings (not shown) on the side frame plates 12,14 for reciprocal motion in its plane between rest position, where it lies during the stapling operation, and a retracted position, e.g., as in FIG. 6, where it stops in the paper sheet bending and folding position. One longitudinal edge has on the upper surface a paper sheet stack guide, i.e., a bar 46 extending longitudinally parallel with the line of reciprocal motion of the tray. The rear, fixed tray 31 has a position adjustable, paper sheet stop bar 48 extending at right angles to the bar 47 and transversely across the upper surface of the tray 31. The bar 48 is mounted on the tray 31 by conventional means (not shown) allowing its position to be adjusted in a direction at right angles to the longitudinal axis of the bar 48.

Figure 6:
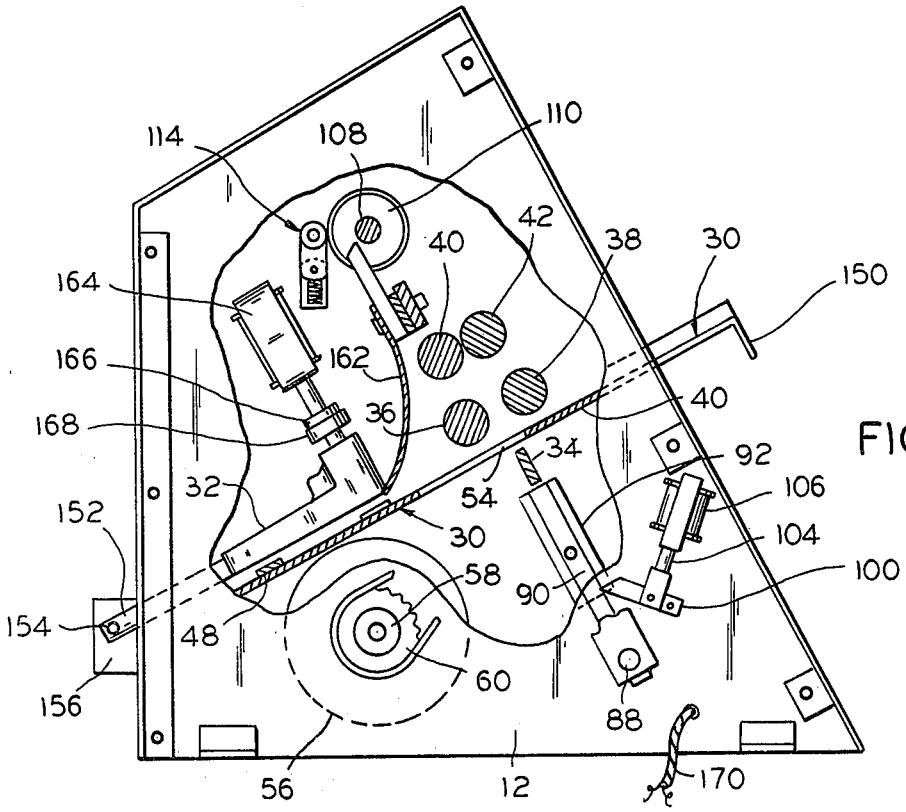
FIG. 6 is a side elevation, partly in broken-away, cross-section, of the side of the machine shown in FIG. 4.

A stack of paper sheets to be stapled and folded is laid on the trays 30 and 31 with two of the sheet's four edges lying against bars 46, 47, 48. The bar 48 is adjustably mounted on the tray and can be shifted transversely in the length direction of the tray in order to compensate for different lengths of paper sheets. Normally the sheets are stapled along the intended fold line when the book is formed. Normally the fold line is midway between the opposite ends of an unfolded paper sheets. The bar 48 is positioned so that the intended fold line lies directly below the staples to be applied to the sheets. Normally the distance from the sheet-abutment edge of the bar 48 and the staple ejection member of the stapler (and also the staple-bending cavities 50 in the staple strike anvils 52) is one half of the length of the paper sheets to be stapled and folded. As is later described in more detail, the retraction of the tray 30 from its rest, stapling position to the sheet bending and folding position moves the staples in the sheets into alignment with the sheet-bending blade 34 so that the sheets are bent and folded along the stapling line. If desired, the bar 48 may be positioned so that the stapling line, and consequently the folding line, are at a place other than the line midway between the ends of the sheets—giving a book with one half of its pages having a width different from the width of the other half of the pages. As can be seen in FIG. 6, the tray 30 retracts far enough so that the blade 34 clears the rear edge of the movable tray 30.

Figure 3:
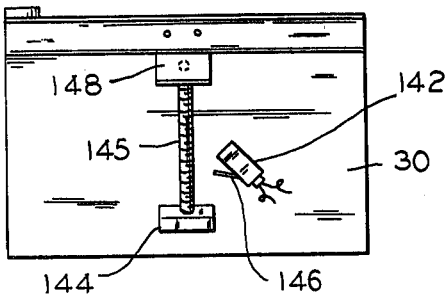
FIG. 3 is a detail view of the underside of a tray as viewed from section plane 3—3 of FIG. 2.

When the operator retracts the movable tray 30, he presses his fingers on the stapled stack of paper sheets and grasps the lip 150 of the tray 30 with his thumb. The paper sheets thus move with the tray 30 away from the rear paper guide bar 48 until the tray comes to a stop, usually with the stapling line aligned with the blade 34. The stop may be, for example, a nut threaded on the threaded rod 145 (FIG. 3) which strikes a surface on a fixed member through or near which the rod 145 passes.

THE DRIVE

The drive means for the machine is the electric motor 56 whose rotor is coupled to its shaft 58 by an electromagnetic clutch/brake. The shaft 58 drives sprocket 60 of the chain/sprocket transmission 62, by which rollers 36,38,40, 42 are driven rotatably. The chain/sprocket system is composed of the drive sprocket 60, the chain 64, the rollers' sprockets 66,68,70,72, a pair of idler sprockets 74,76, and a driven sprocket 78. The latter drives the disc 80 with its eccentric pin 82 in the arrow direction in FIG. 4.

The pin 82 projects through a longitudinal slot 84 in the arm 86, which is reciprocally pivotally driven by the orbiting pin 82. The arm 86 is pivotally connected by the rod 88 to a bar 90 which is slidably mounted in a slide bearing 92 on the side plate 12. The bar 90 in turn is fixed to the blade 34 so that reciprocal motion imparted through pin 82 to arm 86 and in turn to bar 90 reciprocates the blade between retracted position (FIG. 6) and extended position where the blade projects through tray space 54 and between rollers 36,38.

THE BLADE RETAINER

Figure 5:
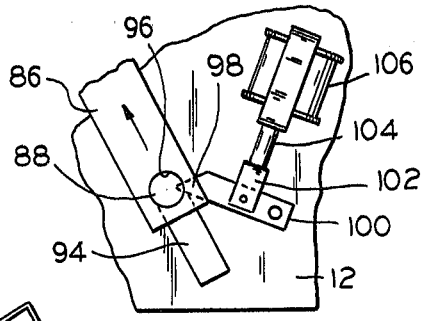
FIG. 5 is a side elevation, detail view of a segment of the machine.

The side plate 12 has a diagonal slot 94 (FIG. 5) through which extends the rod 88. The rod 88 has a notch 96 positioned to catch the pointed tip 98 of a dog 100, which is pivotally mounted by yoke 102 on the movable core 104 of the solenoid 106. When the solenoid is not energized, the core 104 is withdrawn so that the tip 98 of the dog 100 moves out of the range of notch 96. When it is energized, the dog 100 moves downwardly so that its tip 98 is in the range of notch 96. The arm 86, after being raised by orbiting pin 82, is prevented from returning by gravity by the tip 98 in notch 96. The disc 80 and its pin 82 can continue to rotate since the pin 82 is free to move back and forth in the slot 84.

BOOK EJECTION

The driven sprocket 78 rotates shaft 108 which extends the width of the machine between side plates 12,14. Book ejection wheels 110,112 are mounted on the shaft 108. They coact with a yieldable, spring loaded pressure roller assembly 114 (FIG. 6), between which the saddle stapled, folded books pass, upon leaving rollers 40,42, in a rearward, substantially horizontal direction. The books 116 fall onto receiving tray 118 having a diagonal bottom 120 and a stop wall 122. The tray 118 hooks removably on the rear side of the machine.

BLADE ARTICULATION

The portion of shaft 108 which projects through side plate 14 (FIGS. 7 and 8) rotates the disc 124 mounted thereon. The disc 124 has an eccentric pin 126 and a peripheral notch 128. The orbiting pin rides in the longitudinal slot 130 of the arm 132. The lower end of the arm 132 is mounted on the rod 88, which extends the width of the machine and is slidable in diagonal slot 134 in the side plate 14, as well as in the diagonal slot 94 in side plate 12. The orbiting pin 126 pivots and raises the arm 132, but its return downward is by gravity. Thus, the orbiting pins 82,126 articulate the arm-rod-arm assembly 86,88,132 diagonally up and down with oscillation of the upper ends of the arms 86,132 about the pivot axis at rod 88. When the dog 100 arrests downward return by the arm-rod-arm assembly, the orbiting pin 126 rides back and forth in slot 130 of arm 132.

The side plate 14 has thereon two electrical switches 136 and 138. The blade 34 is raised when pins 82,126 orbit 180° from their positions shown in FIGS. 4 and 8, respectively. It is desirable that the blade 34 remain in its extended, raised position until roller pair 36,38 and roller pair 40,42 fold and move the book toward ejection from the machine. Therefore, before the blade becomes fully extended, solenoid 106 is energized so that the tip 98 of dog 100 enters notch 96 in rod 88 as the arm 86 starts to descend. This keeps the blade 34 in its raised, extended position until the solenoid 106 is deenergized and the dog 100 is withdrawn, at least one second.

ELECTRICAL COMPONENTS

The arm 140 of the switch 136 rides on the peripheral edge of disc 124. When the arm enters notch 128, switch 136 is closed and through wiring (not shown) energizes solenoid 106. The latter stays energized until notch 128 makes a 360° orbit, again engaging arm 140. Now the switch 136 is open, deenergizing solenoid 106, retracting dog 100, and allowing the arm-rod-arm assembly 86,88,132 to move downwardly under gravity and retract the blade 34. When rod 88 and arm 132 reach bottom position, they activate switch 138, which through wiring (not shown) deenergizes the electric motor 56—bringing the machine to rest.

The motor 56 is energized through wiring (not shown) via switch 142, which is fixedly mounted just beneath the tray 30. It is closed by a bar 144 adjustably, threadedly mounted on the threaded rod 145 which in turn is slidably supported in a bearing block 148 attached to the underside of the tray 30. When bar 144 contacts blade 146 of the switch 142, it closes and the motor 56 is energized. Nuts 147 on the threaded rod 145 serve as position adjustable stops for the fully retracted position of the tray 30 to stop the tray with the staples in the book aligned with the blade 34.

STAPLING AND FOLDING

After laying a stack of paper sheets to be bound on the trays 30 and 31 against the guide bars 46, 47 and 48, the staples are then applied, as described below. The operator then grasps the lip 150 of the tray 30 and the stapled stack of paper sheets and pulls the tray 30 diagonally outwardly toward him until the tray stops in its outwardly extended position (FIG. 6). This moves the stack of stapled sheets to the position where the fold line (also the line of stapling) is aligned with the extended plane of blade 34. Switch 142 has been closed by bar 144 so that the motor 56, now energized, activates the chain-sprocket transmission drive 62 to rotate the rollers, wheels and move the blade to its upward, extended position.

THE STAPLERS

The staplers 32 are the usual type found in offices, but do not have the base or stand, only the stapling heads. Each stapler head is mounted on an arm 152 (FIG. 9), each of which extends radially from a shaft 154 rotatably journalled in bracket bearings 156,158—thereby allowing the stapler heads to swing at the ends of their arms 152. Each head is suspended by a coil spring 160. The heads are kept from swaying laterally by curved guide bars 162 having forked ends about the sides of the stapler heads (FIG. 6). Three stapling positions are provided, the middle position being shown without a stapler therein.

Figure 2:
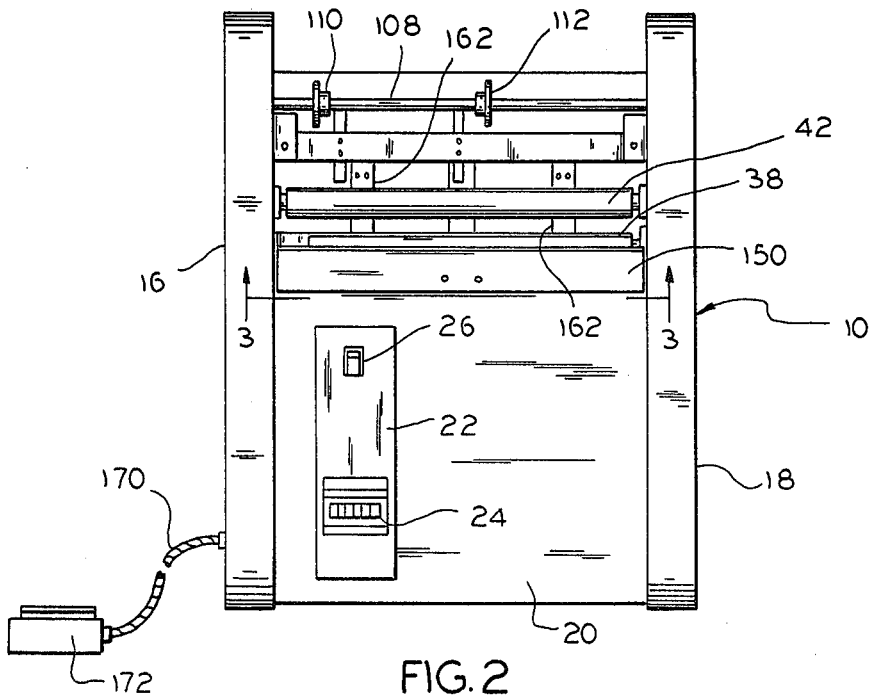
FIG. 2 is a front elevation thereof with an upper, front panel removed.

A solenoid 164 with a strike pad or plate 166 is positioned opposite and above the pressure pad or plate 168 of each stapler head. The solenoids are energized through electrical wiring 170 (not shown in detail) connected to a manual switch, e.g., a foot operated switch 172 (FIG. 2).

BEARINGS FOR ROLLERS

Figure 4:
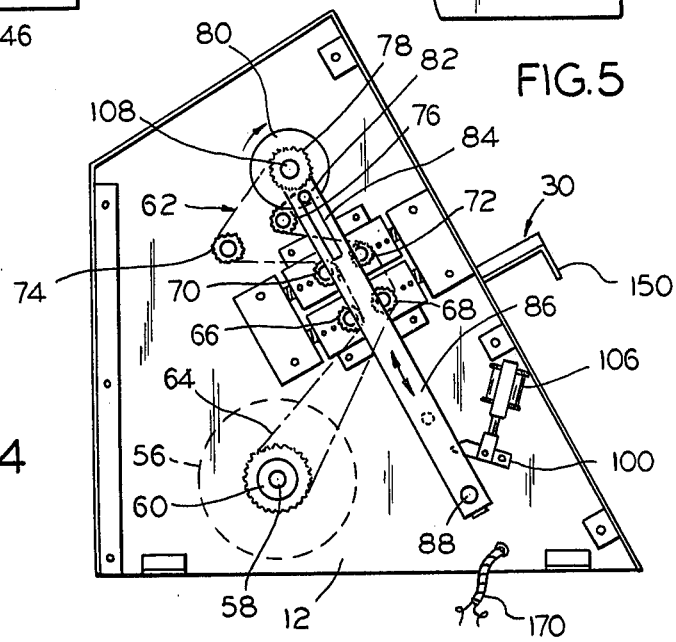
FIG. 4 is a side elevation of one side of the machine with the side panel removed.
Figure 7:
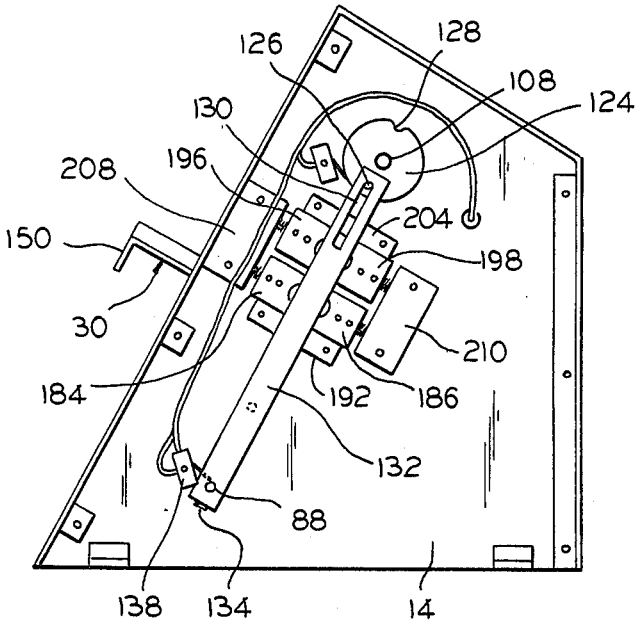
FIG. 7 is a side elevation of the opposite side of the machine with the side panel removed.
Figure 8:
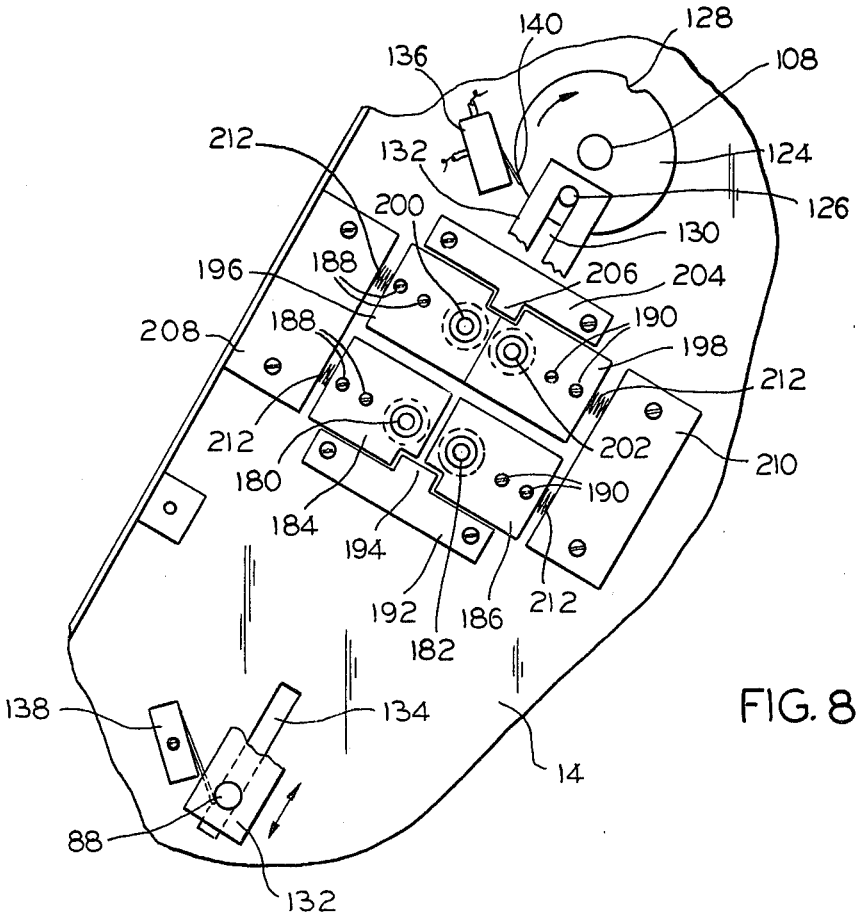
FIG. 8 is a detail view of the side shown in FIG. 7, with parts broken away, to illustrate the journal blocks for mounting the roller pairs of the machine.

The bearings for the shafts of rollers 36,38,40,42 are mounted on the side plates 12,14 and are illustrated in FIGS. 4, 7 and 8. The shafts 180,182 at opposite ends of rollers 36,38 are mounted in bearing plates 184,186 mounted by allen head screws 188,190 on mounting plates on the inner faces of the respective side plates. Bearing plates 184,186 slide on the cross leg of the inverted-T bar 192, which is attached to the side plate by screws. The contiguous lower corners of the bearing plates 184,186 are notched, and the leg 194 of the inverted-T bar is positioned in the notches. The leg 194 limits the movement of bearing plates 184,186, (and hence also the movement of rollers 36,38) toward each other to assure that rollers 36,38 are always spaced apart a minimum distance or do not excessively press against each other, if not normally spaced at their nip.

Bearing plates 196,198 serve as the journals for the shafts 200,202 at opposite ends of the rollers 40,42. Bearing plates 196,198 are mounted on the side plates 12,14 by mounting plates on the inner faces of the respective side plates, which bearing and mounting plates are joined together by allen head screws like 188,190, supra. The upper edges of the bearing plates 196,198 rest against the lower edges of the cross leg of a T-bar 204. The contiguous, upper corners of the bearing plates 196,198 are notched. The leg 206 of the T-bar 204 is positioned in the notches and limits movement of the bearing plates 196,198 (and hence the rollers 40,42) toward each other to a minimum spacing between rollers.

Blocks 208,210 are mounted on the side plates 12,14 opposite the respective outer edges of the bearing plates 184,196 and 186,198. Coil springs 212 are respectively seated in opposed blind holes (not shown) in opposed edges of the blocks 208,210 and the bearing plates. The springs serve as yieldable pressure members for the bearing plates and urge the rollers 36,38 and 40,42 toward the narrowest nip spacing. The rollers 36,38 and 40,42 spread apart as the folded paper sheets pass therethrough.

SECOND EMBODIMENT

Figure 9:
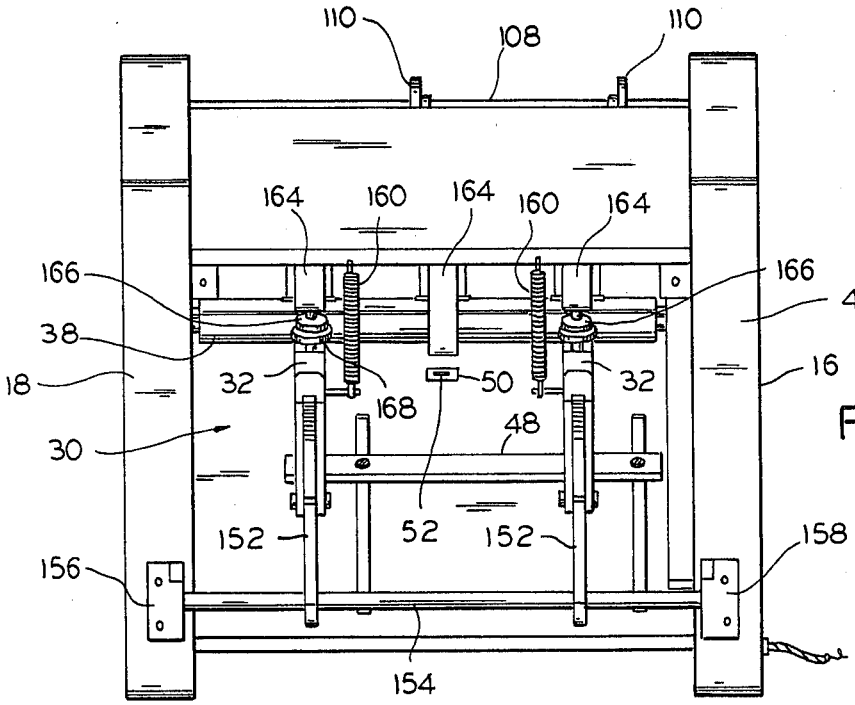
FIG. 9 is a rear elevation view of the machine with the book-receiving tray removed.

The embodiment of FIGS. 10–13 is similar in most respects to the embodiment of FIG. 9. Where applicable, like numerals designate like parts.

The reciprocable tray member 30 in FIG. 2 is reciprocably mounted on the machine by a pair of slide blocks 220 fixed to the underside of the member 30. These blocks slide on rods 222 fixedly mounted by blocks 224,226 on the fixed, cross frame plate 228.

Figure 10:
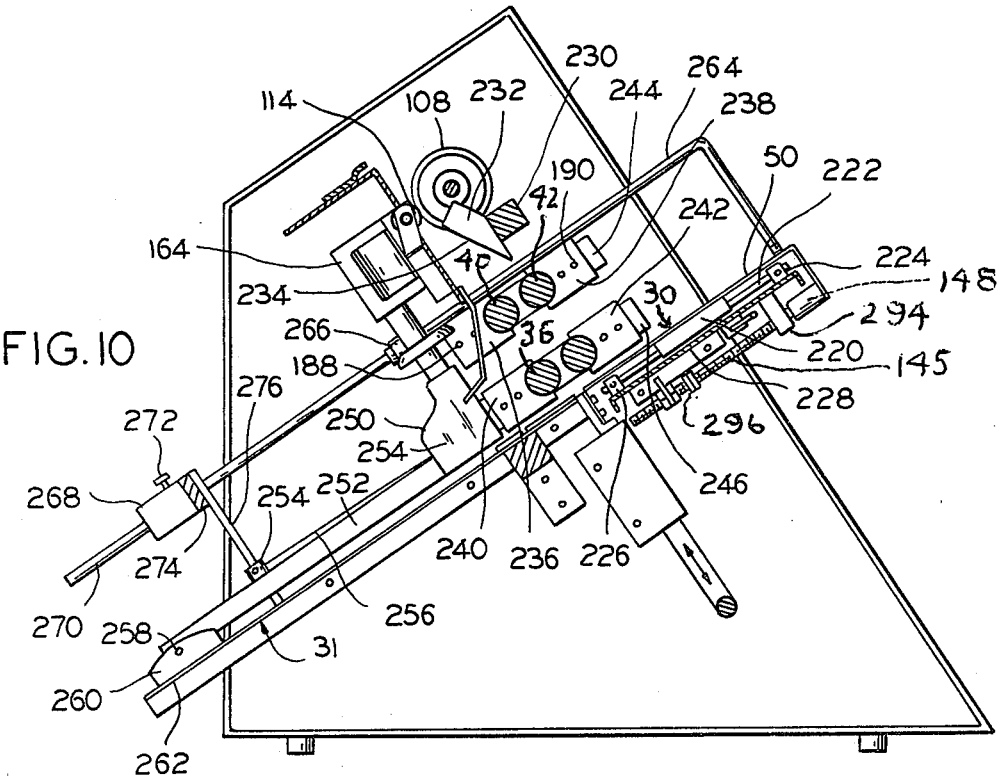
FIG. 10 is a vertical section view of a machine which is a second embodiment of the machines of the invention.
Figure 13:
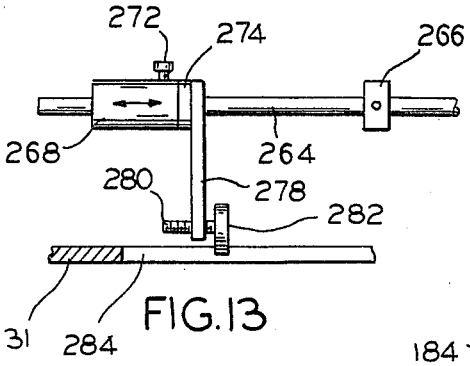
FIG. 13 is a fragmentary, side elevation of the adjustable back guide and its rod support.
Figure 11:
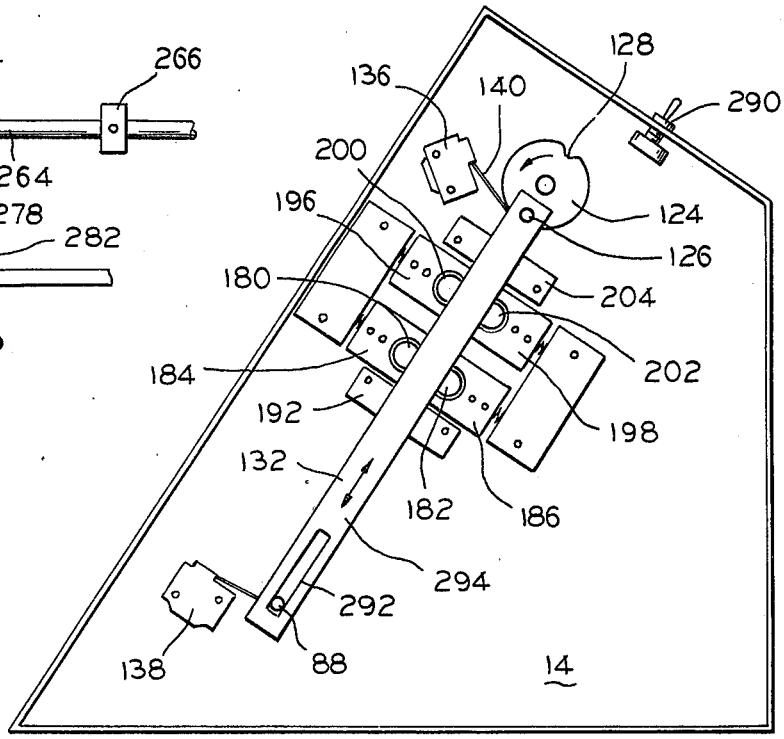
FIG. 11 is a side elevation of one side of this machine with the cover plate removed.

The cross frame bar 230 carries a plurality of tetragonal deflection bars 232, whose sides 234 deflect laterally the books toward the nips of wheels or discs 108,110 and their associated spring biased, pressure discs or wheels 114. FIG. 10 shows the plates 236,238,240,242, which are connected to roller bearing plates 184,186,196 and 198 by the allenhead screws—the respective pairs of connected blocks and plates being slidably mounted in the slots 244,246 in the side plates 12 and 14.

The staplers 250 have long arms 252 in which the staples are placed and urged toward the head by the follower 254 and bias strip 256. Each stapler is pivotally mounted by a pin 258 extending between side walls 260 of the fixed U-bracket 262 and through the rear of the arm 252.

Instead of stop bar 48, the machine has an adjustable back gauge member which reciprocates with the movable tray member 30. Two L-rods 264 are mounted on opposite side edges above the movable tray member 30. They slide in slide bearings 266 mounted on respective side plates. A sleeve 268 is slidably mounted on the rear, free end 270 of each rod. The sleeve may be locked in any adjusted position by the thumb screw 272.

A horizontal cross bar 274 is connected to and extends between the sleeves 268. Two vertical bars 276,278 are attached to and depend from the cross bar 274. Each vertical bar has a screw 280 with a relatively large head 282. The fixed tray 31 has two slots 284 running front to rear of the machine below the tracks of movement of the vertical arms 276,278. The heads 282 of the two screws 280 are the back guide for the paper sheets. They allow fine adjustment of the positioning of the stack on the tray for setting the stapling line or fine tuning the guides 46,47 and 282 to the cut of the paper sheets in order to eliminate later trimming of the books' edges or limiting same to only the edge opposite the fold. The lower edges of the heads 282 are in the slots 284 to keep the bottom-most sheets from sliding under the heads.

Figure 12:
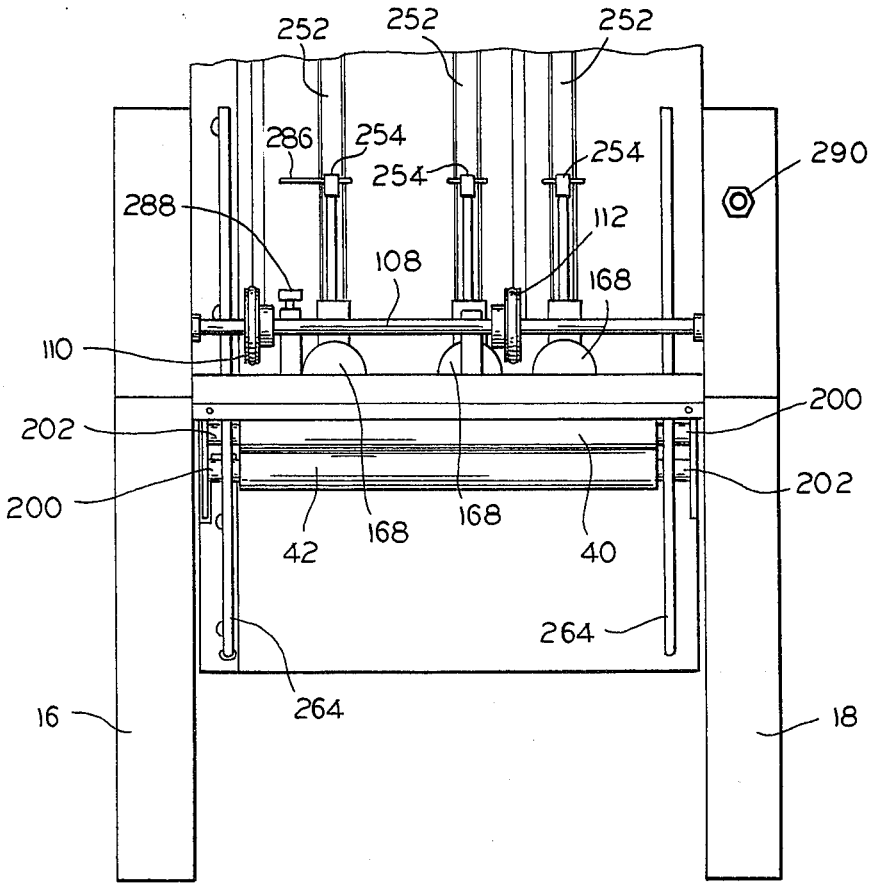
FIG. 12 is a fragmentary, top plan view of this machine.

The spring loaded follower 254 of the left hand stapler in FIG. 12 has an extension arm 286 which contacts switch 288. It is a circuit (not shown) with a buzzer and/or warning light to appraise the operator that the supply of remaining staples in the staplers is low. A three-position toggle switch 290 is connected in the circuits (not shown) to the three solenoids 164 to allow the operator to select to operate only the left hand stapler (FIG. 10), the left hand and middle staplers together or the left hand and right hand staplers.

The slot 292 in the connection arms 294 is provided in the lower part of the arm instead of the upper part as in FIGS. 1–9. The threaded rod 145 passes through a hole in the block 294 fixedly mounted on cross frame member 228. The rod has a pair of nuts 296 threaded thereon. The nuts serve as position-adjustable stops which strike the block 294 and arrest the movable tray 30 in its fully retracted position.

The blade 34 in both embodiments passes through the nip of the lower pair of rollers 36,38 and stops with its edge just short of the nip of upper pair of rollers 40,42. The dog 100 keeps the blade at rest in its fully extended position for at least one second.

It is to be understood that the invention herein claimed is capable of taking many forms other than those herein disclosed and illustrated, and the invention covered by the appended claims includes all such forms within the scope thereof.

I claim:

1. A machine for stapling and folding a stack of paper sheets comprising:

(a) means for receiving an unfolded stack of paper sheets, said means comprising a hand-operated table which has a first position at which said table normally rests and which position it occupies when said unfolded stack of paper sheets is placed thereupon;

(b) means for stapling said sheets together along a stapling line while said sheets are stacked on said means for receiving a stack of unfolded paper sheets;

(c) a first pair of power-driven rollers on said machine forming therebetween a nip to grip and fold said sheets and thereby prefolding said sheets along said stapling line;

(d) a second pair of power-driven rollers also forming therebetween a nip, the last-mentioned nip being aligned essentially parallel with the nip of said first pair of power-driven rollers, on said machine to further grip and fold said sheets as said sheets pass out of said first pair of power-driven rollers;

(e) a blade which is mounted for reciprocal motion between a rest position and an extended position and which urges said stack of papers through said first pair of power-driven rollers and also through said second pair of power-driven rollers;

(f) means for power-driving said rollers;

(g) means for mounting said table for movement by hand by the operator of said machine to convey said stack of unfolded stapled sheets to a second position where the stapled sheets are gripped and folded by said first and second power-driven rollers;

(h) switch means activated by moving said table into said second position, said switch means upon activation energizing operation of said blade and said first and second pairs of power-driven rollers; and (i) means for conveying said stapled sheets out of said machine after folding;

whereby said stack of stapled sheets is lifted off said blade by said first pair of power-driven rollers without separation of said sheets from the staples and said stack of stapled sheets is further folded to essentially a 180° fold by a second pair of power-driven rollers.

2. A machine as claimed in claim 1, wherein said means for stapling said sheets together comprises individual stapler devices which are activated by individual electrically energized solenoids in a circuit having a plurality of switches to close circuits for selected solenoids.

3. A machine for stapling and folding a stack of paper sheets comprising:

(a) Means for receiving an unfolded stack of paper sheets;

(b) Means for stapling said sheets together along a stapling line while said sheets are stacked on said means for moving a stack of unfolded paper sheets;

(c) A first pair of power driven rollers on said machine forming therebetween a nip to grip and fold said sheets and thereby prefold said sheets along said stapling line;

(d) A second pair of power driven rollers also forming therebetween a nip, the last-mentioned nip being essentially parallel with the nip of said first pair of power driven rollers, on said machine to further grip and fold said sheets as said sheets pass out of said first pair of power driven rollers;

(e) A blade which is mounted for reciprocal motion between a rest position and an extended position and which urges said stack of papers through said first pair of power driven rollers and also through said second pair of power driven rollers;

(f) Means for power driving said rollers;

(g) Means for conveying said stack of unfolded stapled sheets to a position where the stapled sheets are stripped and folded by said first and second power driven rollers;

(h) Means for conveying said stapled sheets out of said machine after folding;

whereby said stack of stapled sheets is lifted off said blade by said first pair of power driven rollers without separation of said sheets from the staples and said stack of stapled sheets is further folded to essentially a 180° fold by said second pair of power driven rollers;

said machine further comprising driving means for said blade, including:

(a) A motor driven crank which reciprocally drives said blade such that said crank moves said blade from its rest position in a upward direction to its extended position in which said blade engages said stack of unfolded paper sheets and urges said stack between the nip of said first pair and towards the nip of said second pair of rollers;

(b) An electrical switch with an activating lever which rides against a rotating cylindrical surface of said crank, said cylindrical surface having a depression therein at a point of said surface approximately corresponding to the extended position of said blade such that said lever upon moving into said depression actuates said switch;

(c) A solenoid which actuates a dog engaging said blade; and (d) Means including said switch for controlling said solenoid such that upon a first closure of said switch said solenoid is energized and hence said blade engaged by said dog to hold said blade in said extended position, and, upon a second closure of said switch at the end of another rotation of said crank, said solenoid is de-energized and hence said dog disengaged from said blade to allow said blade to retract from its extended position under the influence of gravity, whereby a dwell is provided for said blade to hold said stack of sheets within the nip of said first pair of power driven rollers.

4. A machine for stapling and folding a stack of paper sheets comprising:

(a) Means for receiving an unfolded stack of paper sheets;

(b) Means for stapling said sheets together along a stapling line while said sheets are stacked on said means for receiving a stack of unfolded paper sheets;

(c) A first pair of power driven rollers on said machine forming therebetween a nip to grip and fold said sheets and thereby prefold said sheets along said stapling line;

(d) A second pair of power driven rollers also forming therebetween a nip, the last-mentioned nip being aligned substantially parallel with the nip of said first pair of power driven rollers, on said machine to further grip and fold said sheets as said sheets pass out of the first pair of power driven rollers;

(e) A blade which is mounted for reciprocal motion between a rest position and an extended position and which urges said stack of papers through said first pair of power driven rollers and also through said second pair of power driven rollers;

(f) Means for power driving said rollers;

(g) Means for conveying said stack of unfolded stapled sheets to a position where the stapled sheets are gripped and folded by said first and second power driven rollers, said conveying means including a movable table on which said stack of sheets is supported, and a back gauge fixed upon said table against which rests the back edge of said stack of papers, the table having a corresponding slot to permit the folding blade to engage said stack, whereby said back gauge presses said stack to move when said table is moved from stapling position into folding position; and (h) Means for conveying said stapled sheets out of said machine after folding;

whereby said stack of stapled sheets is lifted off said blade by said first pair of power driven rollers without separation of said sheets from the staples and said stack of stapled sheets is further folded to essentially a 180° fold by said second pair of power driven rollers.

5. A machine as claimed in claim 4, wherein said back gauge is movable, whereby said back gauge may be adjusted to accommodate paper sheets of varying size, and provides the proper placement of staples in said sheets.

6. A machine is claimed in claim 4, wherein said back gauge member has a fine adjustment provided by a threaded means adjustably engaging a fixed abutment on the machine.

7. A machine for stapling and folding a pack of paper sheets comprising:

(a) A hand operated movable table for receiving an unfolded stack of paper sheets;

(b) Individual staplers for stapling said unfolded stack of paper sheets;

(c) A foot switch activated by the operator of said machine to operate said staplers;

(d) A back gauge fixedly attached to said movable table and which moves with said table, for the purpose of holding said stack of unfolded paper sheets, said table being tilted at an angle to the vertical to allow gravity to urge said paper sheets against said back gauge;

(e) A microswitch operated by said movable table when it is moved from a first position in which it received said stack of unfolded paper sheets and said sheets were stapled, to a second position in which said stapled stack of unfolded paper sheets is folded;

(f) A first pair of power driven rollers having a nip to grip and prefold said sheets and a second pair of power driven rollers also having a nip to fold said stapled stack of paper sheets by approximately 180° upon itself and thereby crease said stack;

(g) A blade which, in moving from a retracted position to an extended position, passes between the first pair of rollers which provide prefolding of the paper stack and moving said stack up to the nip of the second pair of rollers which complete the fold of said stack of paper sheets, said power driven rollers and said blade being activated by said microswitch;

(h) A crank drive for said blade, said crank drive including:

an electrical switch;

means for activating said switch in a position of said crank drive approximately corresponding to the extended position of said blade;

a solenoid which actuates a dog engaging said blade;

means including said switch for controlling said solenoid such that upon a first closure of said switch said solenoid is energized and hence said blade engaged by the dog to hold said blade in said extended position, and, upon a second closure of said switch at the end of another rotation of said crank, which provides a dwell, said solenoid is de-energized and hence said dog disengaged from said blade to allow said blade to retract from its extended position under the influence of gravity, whereby said crank drive for said blade provides said blade with a smooth motion which permits said first pair of rollers, and subsequently said second pair of rollers, to lift said stack of paper sheets without separating said sheets from said staples, and (i) A receiving table for receiving said folded sheets after ejection from said second pair of rollers.

8. A machine for stapling and folding a stack of paper sheets comprising:

(a) Means for receiving an unfolded stack of paper sheets;

(b) Means for stapling said sheets together along a stapling line while said sheets are stacked, in a first position, on said means for receiving a stack of unfolded paper sheets;

(c) A first pair of power driven rollers on said machine forming therebetween a relatively wide nip to grip and prefold said sheets along said stapling line;

(d) A second pair of power driven rollers forming therebetween a relatively narrow nip, the last-mentioned nip being aligned essentially parallel with the nip of said first pair of power driven rollers on said machine to further grip and fold said sheets as said sheets pass out of said first pair of power driven rollers;

(e) A blade which is mounted for reciprocal motion and having an edge for engaging the stack of sheets substantially along the staple line;

(f) Means for reciprocally moving said blade between a rest position and an extended position wherein said edge passes completely through the nip of said first pair of rollers and just short of the nip of said second pair of rollers so as to urge said sheets through said first pair of power driven rollers and to within the grip of said second pair of power driven rollers;

(g) Means for power driving said rollers;

(h) Means for conveying said stack of unfolded stapled sheets to a second position where the stapled sheets are gripped and folded by said first and second power driven rollers; and (i) Means for conveying said stapled sheets out of said machine after folding;

whereby said stack of stapled sheets is lifted off said blade by said first pair of power driven rollers without separation of said sheets from the staples and said stack of stapled sheets is creased to essentially a 180° fold upon itself by said second pair of power driven rollers.

9. A machine as claimed in claim 8, wherein there are provided means to maintain said blade in its extended position with a dwell of at least one second.

* * * * *